US005450632A

United States Patent [19]

Esswein et al.

[11] Patent Number: 5,450,632

[45] Date of Patent: Sep. 19, 1995

[54] STANDING URINAL

[76] Inventors: Thomas J. Esswein; Lawrence A. Esswein, both of 6011 Leona St., St. Louis, Mo. 63116

[21] Appl. No.: 287,618

[22] Filed: Aug. 8, 1994

[51] Int. Cl.[6] ..... A47K 11/12

[52] U.S. Cl. ..... 4/144.1; 4/DIG. 5

[58] Field of Search ..... 4/144.1, 144.2, 144.3, 4/DIG. 5

[56] References Cited

U.S. PATENT DOCUMENTS

| | | | |
|---|---|---|---|
| 2,522,273 | 9/1950 | Johnson | 4/144.1 |
| 3,000,015 | 9/1961 | Hart | 4/144.3 |
| 3,711,871 | 1/1973 | Sherin | 4/144.1 |
| 3,923,040 | 12/1975 | Beach | 4/144.2 X |
| 5,285,532 | 2/1994 | Sealy | 4/144.1 X |
| 5,331,689 | 7/1994 | Haq | 4/144.1 |

FOREIGN PATENT DOCUMENTS

| | | | |
|---|---|---|---|
| 0040181 | 8/1887 | Germany | 4/144.1 |
| 0906726 | 9/1962 | United Kingdom | 4/144.1 |

*Primary Examiner*—Robert M. Fetsuga

[57] ABSTRACT

A urinal including an upper mouth piece which can engage both male and female users and has a handle, an intermediate urine container in the form of an elongated tube with volumetric graduations and a plugged lower end, and a lower telescopic leg having a rubber stopper at the bottom end for frictionally engaging a support surface.

7 Claims, 3 Drawing Sheets

10

10

STANDING URINAL

BACKGROUND—FIELD OF INVENTION

This invention relates to a urinal, specifically a urinal which primarily would be used by a seated or standing individual while urinating and which is essentially self-supporting, or standing, and not needing to be held.

| Related U. S. Patent Documents | | |
|---|---|---|
| 3,964,111 | 6/76 | Packer |
| 4,091,476 | 5/78 | DeBurgh |
| 4,769,858 | 9/88 | Gamm |
| 5,010,599 | 3/91 | Nilssom |
| 5,038,606 | 8/91 | Geschwender |
| 5,091,998 | 3/92 | Witzke |

BACKGROUND—DESCRIPTION OF PRIOR ART

Heretofore, individuals who are not able to urinate directly into a toilet use various adaptations for collection containers to collect the urine. The urine is then properly disposed of from the collection container. These are of various designs, including collection bags, leg bags and urinals.

The selected device is often dictated by whether the individual is in a bed, in a chair, or is ambulatory. Also, the selected design often depends on the condition or health of the individual and the availability of attendant care.

The device of choice, if the using individual is able, is a urinal. It is more convenient and easier to use than other options, is inexpensive, and the possibility of infection is minimized.

A urinal, in its present designs, is basically nothing more than a container. It usually is somewhat of a jug-like container. It may include other design features to simplify collection of the urine and to lessen the possibility of spilling.

Heretofore, such devices had limitations. Users are often old, arthritic, or suffering from an illness, disease or injury and need assistance in getting the urinal. Help is often required to hold the urinal while it is being used because users often are not able to hold the weight of the urinal, particularly as it fills. And if able to hold the urinal, users often are unable to hold it sufficiently steady to use it effectively. Dexterity is one of the primary impediments to proper use of existing urinals because of varying limiting conditions of existing urinals and of the user.

With respect to those suffering from a spinal cord injury, the injury leaves the person as a paraplegic or a quadriplegic. The present method of choice in the medical and rehabilitation fields for draining the bladder is to have the plegic use an intermittent catheter rather that a more permanent internal catheter. Use of an intermittent catheter requires the use of a urinal for collecting the urine from the catheter. However, such an individual often finds it difficult, if not impossible, to manipulate the necessary catheter equipment and, at the same time, hold a urinal. Then, when an attendant assists, privacy is lost because of the individual's inability to hold everything. Even an attendant often has difficulty handling all the items in this situation.

The same is true of many elderly and people suffering with arthritis and other motor disabling afflictions. Due to these conditions, attendant care is almost a necessity and privacy is lost.

Significantly, while most individuals prefer privacy while urinating, the nature of existing urinals is such that an attendant often must be present to help hold the urinal or otherwise assist the user.

What is needed is a urinal requiring essentially no hand dexterity to hold. Also, it should be easy to reach and to set aside and to be emptied. Such a device would provide the user greater privacy and also eliminate the necessity for attendant care to be readily available.

This can be achieved by the use of the standing urinal, or self-supporting urinal. This is a urinal that can independently be handled by most users. Also, it can be picked up and emptied with no difficulty or set aside to be emptied later. It can include a simple handle at the top for easy use by those with limited hand and finger dexterity.

A standing urinal is of such a design that it can be set on the floor, thereby supporting its weight and the weight of the discharged urine. It relieves the user from holding the collection container. It can be positioned easily so as to be used by a person with limited dexterity. And it can be at the desired height for the user without the necessity to hold it up or to set it on a chair or other supporting object. Additionally, it is convenient in size and easily fits in front of the user. Significantly, it permits greater privacy.

It is longer and thinner in design than existing urinals, which gives it its self-supporting feature. It sets on the floor slightly in front of the user, whether seated or standing. The input top end, or mouth, of the standing urinal leans against the user at the crotch or lap area, thereby minimizing the possibility for its falling over.

Heretofore, all urinals suffered from a number of inherent disadvantages:

(a) They are generally bulky in shape,
(b) They are not easy to hold,
(c) They can easily be dropped,
(d) They are very difficult to handle for users with limited dexterity, such as the old and the feeble,
(e) They are difficult to handle for users with spinal cord injuries, such as plegics, and users with arthritis and other motor disabling afflictions,
(f) They decrease the privacy of the user since an attendant often has to be available,

ADVANTAGES

Accordingly, several advantages of the standing urinal are:

(a) It does not have to be held,
(b) It is very easy to pick up, to move, to empty and to manipulate,
(c) It is self-supporting,
(d) It is adjustable in height,
(e) It is not bulky,
(f) It is very light in weight,
(g) It is designed such that the reservoir portion of the urinal contributes to it being self-supporting,
(h) It is easy to use by seated users,
(i) It is easy to use by standing users,
(j) It, with its contents, does not have to be continuously held or supported by the user,
(k) The urine contents can be easily examined before the standing urinal is emptied as the container portion can be made using a translucent or transparent material, (l) The amount of the urine contents can be measured by viewing graduated markers on the longitudinal axis of the standing urinal, (m) It is easy to position for use, (n) It can be used by people with limited or no hand or finger dexterity including those suffering from spinal cord injuries such as plegics by using a flexible elongated handle, (o) It can be used by the old and the infirm, (p) It can be used with a great amount of privacy because an attendant is not required, (q) It can be used by staffs in hospitals, spinal cord rehabilitation centers, other rehabilitation centers, retirement homes, homes for the aged, and in the residential home.

Still further objectives will become apparent from a consideration of the ensuing description and drawing.

SUMMARY OF INVENTION

Accordingly, it is an objective of the invention to provide a urinal which does not have to be held by a seated or standing user, but rather will be generally self-supporting.

It is a further objective of the invention to provide a urinal which can be easily placed at a convenient height for a seated or standing user.

It is still a further objective of the invention to provide a urinal which can be easily used by the old, infirm, feeble, and users with limited or no hand or finger dexterity including those suffering from a motor disabling injury or disease.

It is still a further objective of the invention to provide a urinal which affords greater privacy to the user and minimizes the amount of required attendant care.

In accordance with the above and further objectives of the invention, a standing urinal includes a container for holding the urine, a mouth to gather the urine as it leaves the body, and optional features such as but not limited to graduated markers for measuring, a strainer, a handle, an adjustable leg, a skid resistant stopper and a male deflection hood.

In the preferred embodiment, the container has a tubular side wall that is transparent or translucent such that the urine can be easily examined. Additionally, graduated markers extend up the side of the container so that the quantity of urine in the container can be easily measured.

In the preferred embodiment, a leg supports the urinal and is adjustable such that the input portion of the urinal can be easily raised or lowered for the convenience of the user and depending on whether the user is seated or standing and, if seated, whether in a standard chair, a wheelchair or on some other support.

It the preferred embodiment, the mouth has a strainer with holes through which the urine may flow but which impedes the passage of debris from falling into the container and, additionally, provides a flat working surface for those users using intermittent catheter equipment. Furthermore, an optional loop handle is included to facilitate picking up, moving, emptying and manipulating the urinal.

The design of the standing urinal is such that it is inexpensive to fabricate, assemble, package and ship.

SUMMARY OF THE DRAWINGS

The above-noted and other features of the invention will be better understood from the following detailed description of one preferred embodiment when considered with reference to the accompanying drawings in which.

DETAILED DESCRIPTION

STANDING URINAL

While the following description contains many specificities, these should not be construed as limitations on the scope of the invention, but rather as an exemplification of one preferred embodiment thereof. For example, the description pertains to a standing urinal used by males. This does not mean that the scope of the invention is limited to males, when, in fact, it is not and can also be adapted for use by females.

Figure 1:
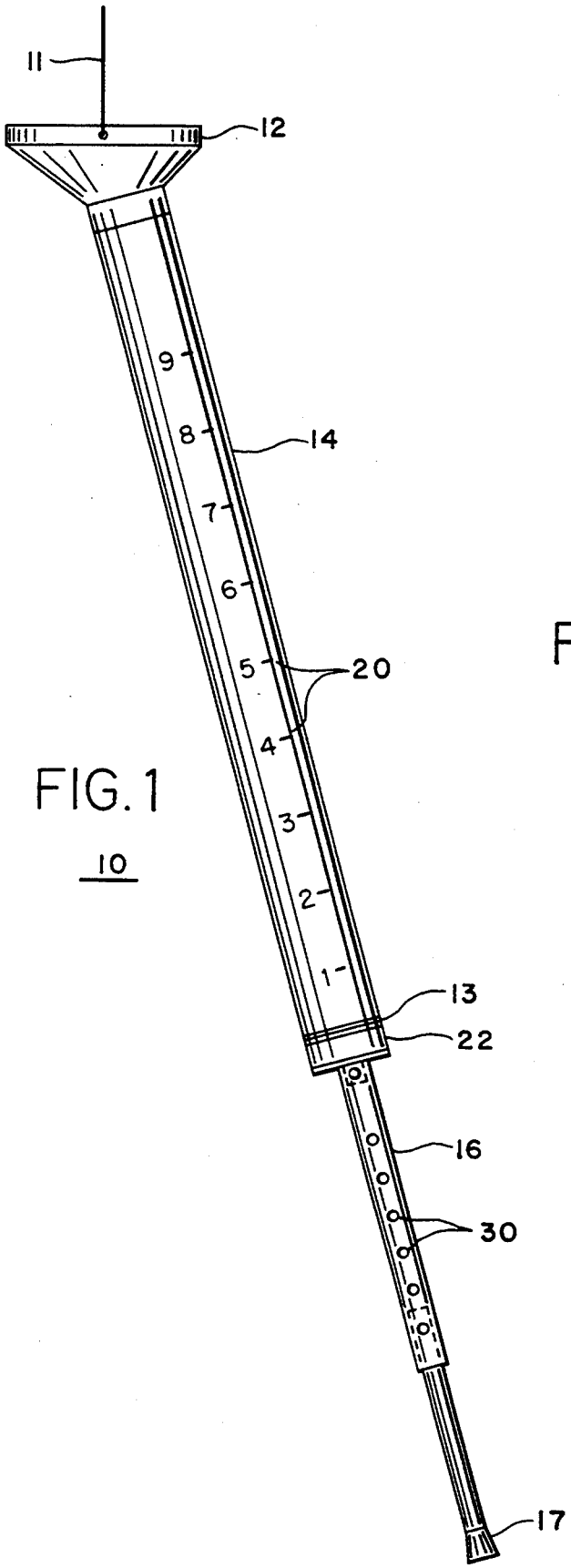
FIG. 1 is a side view of the standing urinal, including an optional flexible elongated handle, as it would appear when leaning against a sitting or standing individual.
Figure 6:
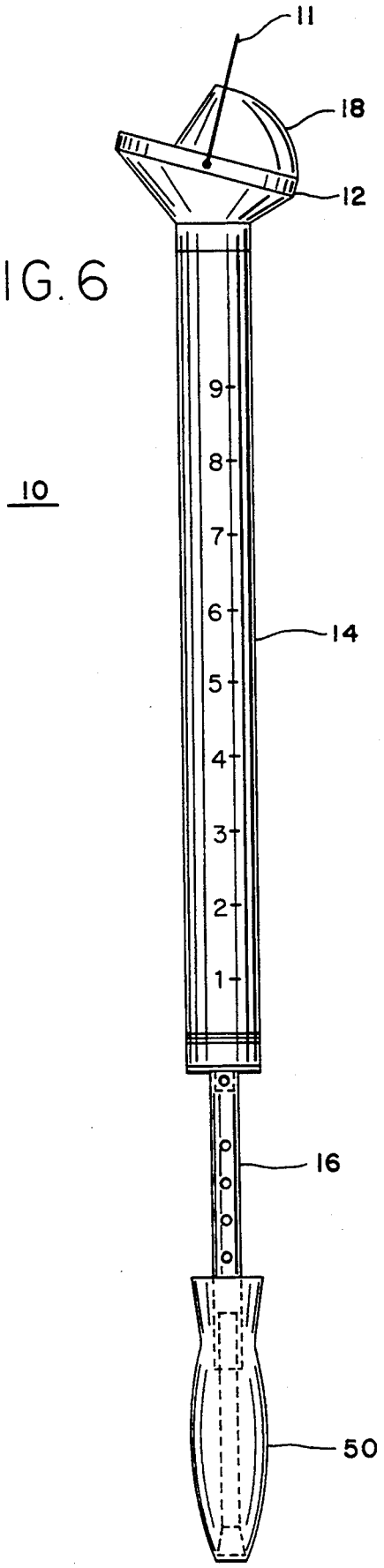
FIG. 6 is a side view of the standing urinal of FIG. 1 and including an optional mouth deflection hood for use by males, and is shown while not in the using position but rather while it might be stored near or convenient to the user and it is sitting in a flower-like vase holding container.
Figure 7:
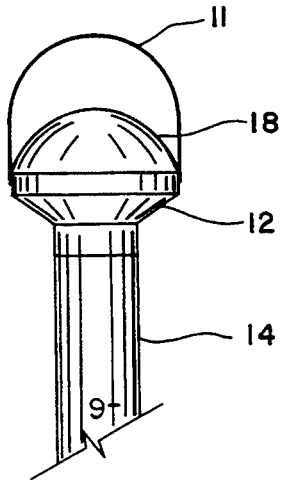
FIG. 7 is a rear view of the top portion of the embodiment of the standing urinal of FIG. 6 including the mouth deflection hood.

Additionally, an elongated small diameter flexible handle, one end fastened on each side of the top of the mouth, by which the standing urinal can be picked up and also can be hung, fits across the top near the center of the mouth just like a handle fits on a bucket, and, while optional, is included as part of the preferred embodiment in FIG. 1. Also included are optional graduated markers for measuring and an optional adjustable leg so the standing urinal can be conveniently used by users of different seated and standing heights. Additionally, a skid resistant stopper can be affixed to the bottom of the standing urinal to guard against sliding, and, while optional, is included as part of the preferred embodiment in FIG. 1. Furthermore, a deflection hood can be a standard or optional accessory to the standing urinal and would fit on the portion of the mouth away from the user. It is not shown in the preferred embodiment of the standing urinal in FIG. 1 but is shown in FIG. 6 and FIG. 7 which illustrates this optional addition. Similarly, FIG. 6 also illustrates an optional way to store the standing urinal while in daily use which is to set it in a container which has a sufficiently narrow top which thereby causes the standing urinal to remain essentially straight up. This can simply be a flower vase or other similar object.

In FIG. 1, there is shown a side view of the standing urinal 10 having an interface means, herein referred to as the mouth 12, and a container 14 which is connected to leg 16. In the preferred embodiment, container 14 is a cylindrical transparent plastic tube open at both ends. It has a wall approximately 1/32 of an inch thick. Container 14 includes a number of graduated markers on its side which extend upward along its longitudinal axis and are indicated generally at 20 for convenience. The upward open end of container 14 receives mouth 12 so that urine discharged into mouth 12 flows into container 14. The lower open end of container 14 is closed at its bottom by the top end of plug 22 of leg 16 which is of separately molded plastic with the top of plug 22 having an outwardly extending ridge, and a collar which fits inside of the tube to form a sealed container.

Thereby, container 14 has a watertight bottom, with an "0" ring gasket 13, and sides to hold the liquid urine. It is sized, both in diameter and length, along with leg 16, to minimize manufacturing, packaging and shipping costs of the standing urinal, while at the same time with container 14 having sufficient reservoir volume for the receipt and holding of the amount of urine for which it is designed. For the purposes of this DETAILED DESCRIPTION a volume V of 1000 cc (cubic centimeters) is discussed. Herein,container 14 has a volume V, a container diameter CD and a container length CL.

In the preferred embodiment, the overall length, OL, of container 14 and leg 16, when fitted together, is such that mouth 12 of the standing urinal reaches the user about the crotch or lap or other comfortable height, depending on the height of the user, and also whether the user is seated or standing; and if seated in a chair, whether the chair is a standard chair or a wheelchair or some other support. To achieve this objective, and also to provide flexibility for different seated and standing heights of users, the length of leg 16, or leg length LL, is such that the sum of container 14 length CL plus leg 16 length LL equals an OL of approximately 32 inches. The length of leg 16 is adjustable as hereinafter described.

Also, for the purpose of this DETAILED DESCRIPTION, an inside diameter of 2 inches is used for container 14 diameter CD. With a desired reservoir volume V of not less than 1000 cc, container length CL will be about 22 inches, including room for inserting the plug 22 top of leg 16 into container 14.

Container 14 need not be cylindrical nor of any specific diameter CD or length CL except that it must be sized in relation to the inlet of mouth 12, the top of plug 22 of leg 16 and the desired volume V holding capacity of the standing urinal. While a cylindrical transparent plastic tube is cited, any other transparent material may be used including glass.

In the preferred embodiment, the graduated markers 20 are printed onto the outer surface of the cylindrical tube of container 14 and placed, in 100 cc increments, from the bottom up, and numbered from 1 to 9, to indicate the amount of volume of collected urine so as to be as informative as possible to the user and any attendant.

Figure 3:
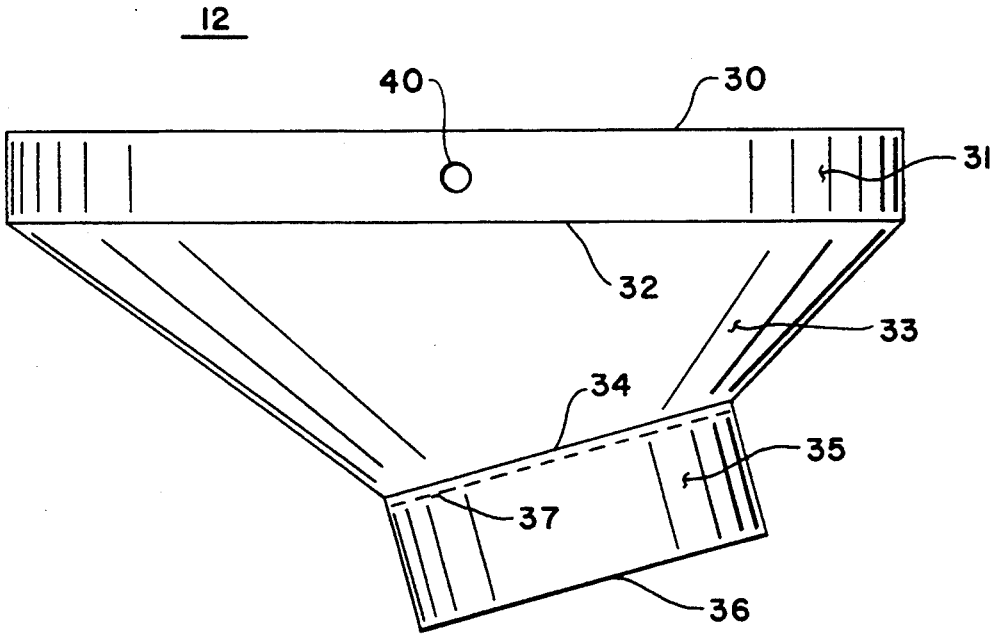
FIG. 3 is a side view of a portion of the embodiment of the standing urinal of FIG. 1.
Figure 4:
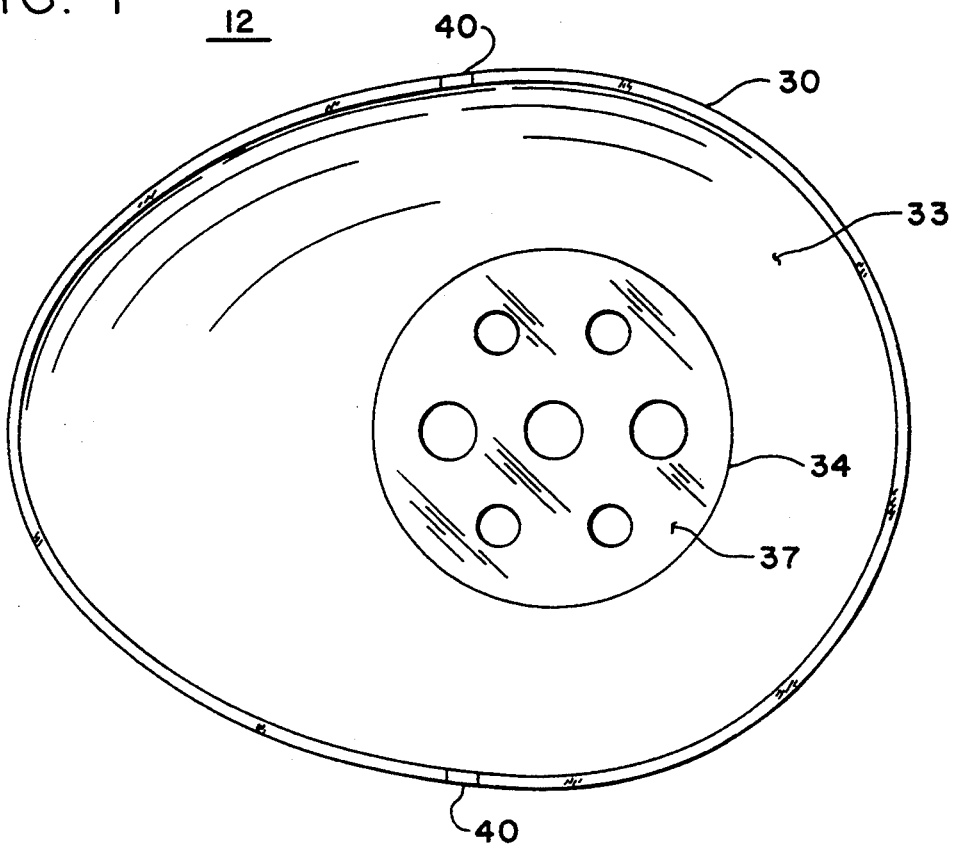
FIG. 4 is a plan view of a portion of the embodiment of the standing urinal of FIG. 1 as shown in FIG. 3.

For discussion purposes it is assumed that the standing urinal, as illustrated in FIG. 1, is sitting up and leans against the user at a 75 degree angle with the floor. The plane of the top of mouth 12 is parallel with the plane of the floor. Thereby, with the intercept strainer 37, as shown in FIG. 3 and FIG. 4, the standing urinal (less the optional deflection hood 18) provides a small table-like working area for use by those using catheter equipment. Handle 11 is easily pushed down or aside and is not an obstacle.

FIG. 3 is a side view of the preferred embodiment of mouth 12 which is of a funnel-shaped design and made of high impact plastic of any suitable type and has a general wall thickness of approximately 1/16 inch. It is firmly mounted, in sealing relationship, to the wall of container 14 and provides for the relatively smooth flow of urine into container 14. FIG. 4 is a plan view of FIG. 3.

The preferred embodiment of mouth 12 has the plane of the top-most cross-sectional area 30 and a second congruent cross-sectional area 32 with the areas being parallel and ½ inch apart. The shape of each area is such that the right side is the right ½ half of a circle with a radius of 2 inches, and the left side is the left ½ of an ellipse which has a larger radius of 3 inches and a shorter radius of 2 inches and a formulae of $4x^2+9y^2=36$. A third cross-sectional area 34 and a fourth cross-sectional area 36 are parallel and congruent to each other and ¾ inch apart and have cross-sectional areas of a circle approximately 2 inches in outside diameter and being the same size as the inside diameter of container 14. Mouth 12 is molded in one piece such that the connection of the circumferences of area 30 and area 32 form the top and bottom sides of upper portion 31 of funnel-like mouth 12. Similarly, the connection of the circumferences of areas 34 and 36 form the lower portion 35 of mouth 12 and is of cylindrical shape and can be inserted into container 14.

The molded connecting middle portion 33 wall of mouth 12 is formed between upper portion 31 and lower portion 35 and is irregular in cross-sectional area. The upper right wall of middle portion 33 slopes down and inward from the lower-most right point of upper portion 31 and at an external angle of 225 degrees. It connects with the top-most right point of lower portion 35 at a point 1 inch below area 32 and 1 inch left of the right side of upper portion 31. The right wall of middle portion 33 and the right wall of lower portion 35 have an external included angle of 120 degrees.

The upper left wall of middle portion 33 slopes down and inward from the lower-most left point of upper portion 31 and at an external angle of 230 degrees. It connects with the top-most left point of lower portion 35 at a point,approximately 1 and ½ inches below area 32. The left wall of middle portion 33 and the left wall of lower portion 35 have an external included angle of approximately 145 degrees.

The one-piece mouth 12 is molded to include area 34 as an intercept strainer 37 which serves as separating wall. Its purpose is to be a separating wall with holes to permit urine to flow into container 14 but prevent other items and debris from falling into container 14. Strainer 37 has holes, some of which are larger than the others, to permit the easy escape of air.

So that mouth 12 and container 14 can be easily connected, the outside wall of the bottom ⅛ inch of lower cylindrical portion 35 of mouth 12 slopes inward such that it has a diameter 1/64 inches less than the inside diameter of container 14. Therefore, mouth 12 and container 14 will connect together with a press fit manually but could be sealed by an adhesive, adhesive tape or formed directly together in other embodiments. The press fit, possibly using adhesive tape as a safeguard fastener, has some advantage in fabrication cost.

Figure 2:
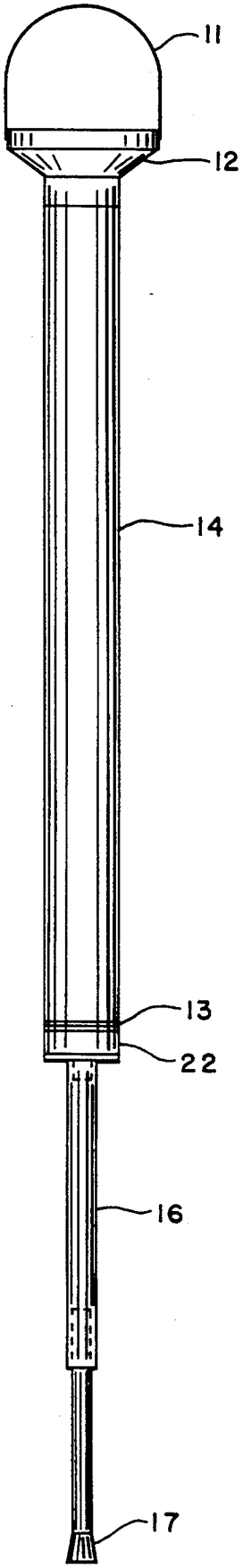
FIG. 2 is a rear view of the standing urinal of FIG. 1.

An elongated small diameter flexible loop handle 11, shown in FIG. 1 and FIG. 2, can be fastened in an arch shape across the top of mouth 12 to simplify picking up, positioning, moving and emptying the standing urinal. The plane of handle 11 is from side-to-side of mouth 12 and perpendicular to the axis of mouth 12 which runs from back to front of mouth 12 and points directly to the user while the standing urinal is in use. Handle 11 consists of a thin plastic cord substance of small diameter and is arched over the top of mouth 12 like an elongated handle on a bucket. It is fastened through a small hole 40 on both the left and the right sides of mouth 12 near its top. Handle 11 easily pushes down or aside and is not an obstacle. In addition to using handle 11 as described above, it also can be used as a hanging device while the standing urinal is not in use and is being stored. Handle 11 can be made of any other material, including metal wire.

Figure 5:
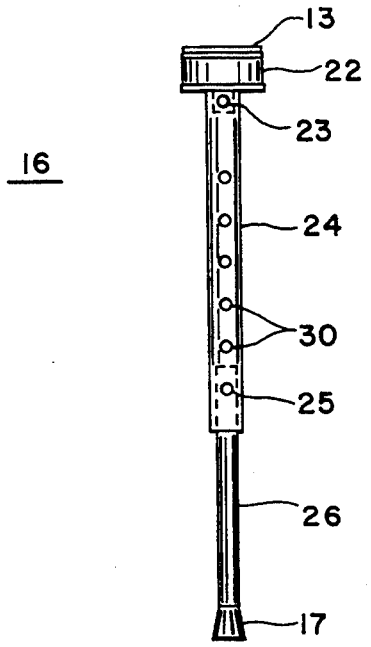
FIG. 5 is a side view of the standing urinal of FIG. 1.

FIG. 5 is a side view of leg 16 which is designed to be adjustable and includes a plug top over which container 14 is press fit manually.

Plug 22 is molded of high impact plastic of any suitable type. In the preferred embodiment, the plug 22 portion of leg 16 is 1 inch in length and has a diameter substantially equal to the inner diameter of the cylindrical tube of container 14 with the annular bottom ledge being 1/32 inch and flush with the outer wall of container 14, thereby supporting container 14. Additionally, ¾ inches from the bottom ledge, the radius of plug 22 is 1/32 inches smaller than the lower portion and has a annular shoulder ledge thus permitting plug 22 to be tightly inserted into container 14 with an "O" ring gasket 13 fitting at the shoulder ledge thereby providing a water-tight seal.

The bottom of plug 22 of leg 16 has a molded stub in the center over which leg top 24 fits. A hole in the stub through the diameter and perpendicular to the longitudinal axis of leg 16 permits a pin 23 to be placed through this hole and the top holes in leg top 24 to fasten these leg 16 components together.

Leg 16 includes two tube-like sections, leg top 24 and leg bottom 26, which have diameters of approximately ¾ and ½ inches, and are constructed such that leg bottom 26 section slides into leg top 24 section in a telescopic manner. In the preferred embodiment of leg 16 it consists of two tube-like sections, leg top 24 and leg bottom 26, however, there could be additional telescopic sections between 24 and 26. Leg top 24 has small holes at intervals along the lateral longitudinal axis and are indicated generally at 30 for convenience. Leg bottom 26 has a spring-loaded insert 25 fastened near its top such that, when leg bottom 26 is slid into leg top 24, the two tube-like sections will stay together. This is a simple and convenient way to shorten or lengthen leg length LL. Thereby, the overall length OL of the standing urinal can be adjusted to a convenient height for the user. Simply stated, the length, or height, of the standing urinal is adjustable. A thimble-shaped stopper 17 can be inserted over the bottom end of leg bottom 26 of leg 16 to minimize the possibility of the standing urinal sliding while in use if on a slick floor surface.

If leg length LL of leg 16 is to be shortened or lengthened, spring-loaded insert 25 can be depressed and leg top 24 and leg bottom 26 can be repositioned with respect to each other with insert 25 holding them together at a desired location.

Leg top 24 and leg bottom 26, while tube-like in the preferred embodiment, can be of any cross-sectional area provided that one can fit into the other and be designed for varying the length of leg 16 and also provided that plug 22 and stopper 17 can be attached as herein before described. They can be made of aluminum, plastic or any other suitable material.

In assembling, to close container 14 with plug 22 of leg 16, a fixture is inserted in the bottom of container 14 to expand or flair the tube end outwardly. It may also be lubricated with soap and water. Plug 22 is then inserted and pressed upwardly into container 14 for a press fit with "O" ring gasket 13 being captured by the shoulder ledge between the tube wall and plug 22 thereby providing a water tight seal. The wall returns to its original shape by memory.

FIG. 6 is a side view of the standing urinal of FIG. 1 and shows an optional embodiment for holding the standing urinal while not in the using position. That is, while being stored near or convenient to the user. It illustrates the standing urinal, which is very light in weight because of the material used in its construction, being stored in a flower-like vase container 50. A functionally similar holding container could be used. And as previously described, the standing urinal can be hung for storage by use of handle 11.

Additionally, FIG. 6 shows an optional embodiment for mouth 12 of the standing urinal which is a deflection hood 18 for use by males who are eliminating in the normal manner, that is, who are not using a catheter for draining urine from the bladder. Deflection hood 18 is intended to prevent or minimize the possibility of urine, while being discharged from the body, from going elsewhere than into container 14. Its design would be such that it would be snapped onto mouth 12 and made of the same material as mouth 12. Mouth 12 could include molded indents to accept and hold deflection hood 18 when snapped into place. FIG. 7 is a rear view of the top portion of the standing urinal of FIG. 6.

Although a preferred embodiment of the invention has been described with some particularity, many modifications and variations of the embodiment may be made without deviating from the invention. Therefore, it is understood that, within the scope of the appended claims, the invention may be practiced other than as specifically described.

What is claimed:

1. A portable urinal for collecting and temporarily storing urine of an individual comprising:

an elongated rigid tube having a closed lower end and an open upper end defining a urine container;

a mouth piece adapted to receive urine from the individual, said mouth piece mounted to said open upper end of said container for transferring urine thereto;

an elongated leg mounted at an upper end thereof to said container closed lower end, said leg having a lower end adapted to engage a support surface, said leg including means for adjusting the length thereof, whereby the individual may use the urinal in either a seated or a standing position with appropriate adjustment of said leg.

2. A portable urinal as set forth in claim 1 wherein the container means is made of at least translucent material with graduated markers extending vertically along the container to determine the amount of urine in the container.

3. A portable urinal as set forth in claim 1 wherein the mouth piece includes, a strainer with holes through which urine may flow into the container but which impedes passage of debris.

4. A portable urinal as set forth in claim 1 wherein the mouth piece includes handle means for moving the urinal and for hanging the urinal when not in use.

5. A portable urinal as set forth in claim 1 wherein the mouth piece includes deflection hood means for minimizing the possibility of urine being discharged elsewhere than into the urinal.

6. A portable urinal as set forth in claim 1 wherein the mouth piece is shaped to fit against the vaginal area of a female thereby minimizing the possibility of urine being discharged elsewhere than into the urinal.

7. A portable urinal as set forth in claim 1 wherein the leg lower end includes a skid resistant stopper to minimize the possibility of urinal sliding.

* * * * *